US006682041B1

(12) United States Patent
Branham, II

(10) Patent No.: US 6,682,041 B1
(45) Date of Patent: Jan. 27, 2004

(54) STRUCTURAL FIXTURE ASSEMBLY AND METHOD OF MAKING SAME

(75) Inventor: William K. Branham, II, County of Jefferson, KY (US)

(73) Assignee: Bill Branham Designs, Ltd., Louisville, KY (US)

( * ) Notice: Subject to any disclaimer, the term of this patent is extended or adjusted under 35 U.S.C. 154(b) by 0 days.

(21) Appl. No.: 10/291,324

(22) Filed: Nov. 9, 2002

(51) Int. Cl.[7] ..... A47B 19/00; A47B 23/00

(52) U.S. Cl. ..... 248/441.1; 248/454; 248/459

(58) Field of Search ..... 248/163.2, 174, 248/459, 458, 456, 455, 188, 188.1, 188.8, 441.1

(56) References Cited

U.S. PATENT DOCUMENTS

| | | | | |
|---|---|---|---|---|
| 2,456,964 A | * | 12/1948 | Ledure | 211/33 |
| 3,029,548 A | * | 4/1962 | Braha | 248/455 |
| 4,421,943 A | * | 12/1983 | Withjack | 136/246 |
| 6,347,772 B1 | | 2/2002 | L'Hotel | 248/174 |
| 6,382,581 B1 | * | 5/2002 | Duff | 248/459 |

* cited by examiner

*Primary Examiner*—Ramon O. Ramirez
(74) *Attorney, Agent, or Firm*—Polster, Lieder, Woodruff & Lucchesi

(57) ABSTRACT

A structural fixture assembly arrangement including a through-passage defining frame member and at least one cooperative slotted standard body member engaging therewith and including a foot rest arrangement extending therefrom to provide an erected position for the structural assembly.

22 Claims, 5 Drawing Sheets

STRUCTURAL FIXTURE ASSEMBLY AND METHOD OF MAKING SAME

BACKGROUND OF THE INVENTION

The present invention relates to a structural fixture assembly and more particularly to a unique and novel structural fixture assembly arrangement for supporting an article for display, shipment and storage.

Various structural fixture assembly arrangements are well known in such diverse fields as family picture frames, advertising poster billboards, and storage packaging and shipping. For the most part, the past known assemblies have been comparatively expensive in construction, assembly, and maintenance, requiring numerous construction parts and fastening materials and numerous steps in the assembly of such parts into a final product.

In this regard, attention is directed to U.S. Pat. No. 6,347,772, issued on Feb. 19, 2002 to Francois L'Hotel.

The present invention provides a structural fixture assembly product and method, which can be readily constructed with a minimum of parts and with a minimum of steps in such construction assembly arrangement, without the use of nails, hammers, staples or other fasteners in the assembly operations. Not only is the inventive structural assembly arrangement comparatively straightforward, economical and efficient in construction, assembly and maintenance, requiring a minimum of parts and a minimum of manufacturing steps but, moreover, the present invention provides an efficient arrangement which can be utilized in various sizes and in various industrial arts, such as, but not limited to, the display, storage and freight shipping arts.

Various other features of the present invention will become obvious to one skilled in one or more of the above enumerated arts without departing from the scope or spirit of the present invention.

BRIEF SUMMARY OF THE INVENTION

More particularly, the present invention provides a structural fixture assembly comprising: a frame member having a perimeter defining through-passage therein surrounded by spaced opposed side portions; and, at least one standard body member sized to extend into the defining passage, the standard body member having slots at opposite extremities thereof capable of engaging in fast interlocked relation with the spaced opposed side portions of the frame member and including at least one assembly resting foot member extendable at a selected angle from the standard body member to provide an erected position for the structural assembly.

In addition, the present invention provides a unique, unified method for forming and erecting the structural fixture assembly comprising: feeding a blank sheet of selected material into a first forming zone to sever a frame member from a portion thereof, the frame member having a surrounding perimeter defining through-passage with at least one recess retaining passage severed in the perimeter defining frame member; feeding a blank sheet of selected material into a second forming zone to sever at least one standard body member having a slotted foot member extendable from the body member, as a resting foot, the body member including slots therein at opposite extremities of the body member; the slots being of sufficient depth and breadth to be capable of snuggly engaging cross-sections along opposite faces of opposed sides of the frame member, the severed body member being of sufficient length to permit such engagement of such slots with the frame member.

The present invention further provides for passing a portion of the blank sheet—advantageously that severed portion forming the through-passage to a third severing zone and severing at least one similarly slotted cross member therefrom capable of engaging the foot member when similarly slotted.

The present invention also provides for passing the severed frame member, body member and cross member to a fourth orientation and assembly zone including the steps of passing the opposed slotted body member into the through-passage of the frame member, orienting the body member so that the opposed slots snuggly engage opposite faces of opposed portions of the frame member, extending the rest foot of the body member to a selected angle position, and, if required, fastening the slotted cross-member to the slotted rest foot of the body member for further erected support of the assembled frame and body members.

BRIEF SUMMARY OF THE DRAWINGS

Referring to the drawings which disclose various embodiments of the present invention.

DETAILED DESCRIPTION OF THE INVENTION

Figure 1:
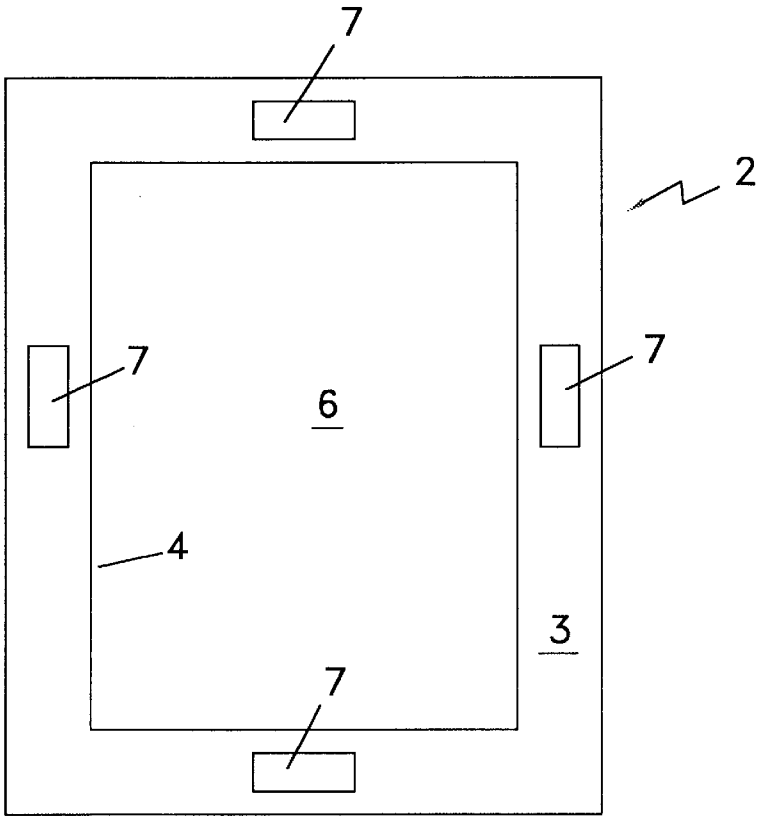
FIG. 1 is a plan view of the inventive frame member having a surrounding perimeter defining rectangular through-passage, the disclosed frame member including spaced opposed pairs of support member aids in the form of opposed apertures.

Referring to FIG. 1 of the drawings, a frame member 2 can be seen. This frame member serves to form part of a structural fixture assembly described hereinafter. It is to be understood that the frame member 2 can be formed in various sizes and shapes, depending upon its destined commercial use—such as for a lighting fixture support or a billboard display where comparatively larger dimensions would be dictated or for a personal picture frame or small advertising display where comparatively smaller dimensions would be utilized.

Figure 4:
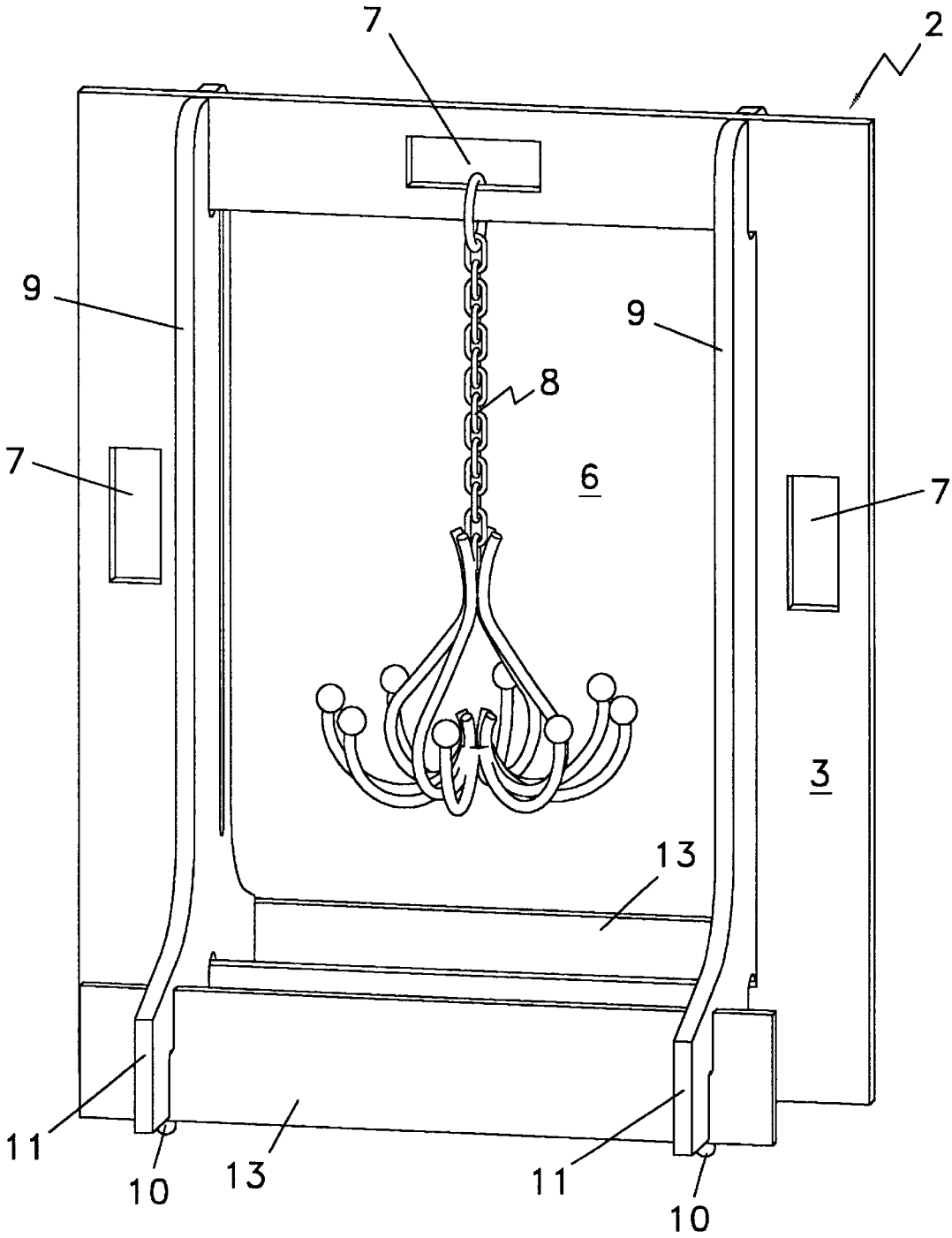
FIG. 4 is an isometric view of one embodiment of the present invention disclosing a large frame member assembled with a spaced pair of mirror-image body members with foot rests having longitudinally extending slotted cross-member support aids engaged therewith, the assembled structure being mounted on caster wheels and arranged to support a lighting fixture for storage and shipping.

In a typical lighting fixture support for shipping and storage, such as shown in FIG. 4 of the drawings, frame member 2 is disclosed as being of rectangular shape with selected dimensions of approximately seventy-one (71) by forty-eight (48) inches (''). The frame member can be formed from anyone of a number of sturdy, selected materials—such as, but not limited to, a fiberboard-like oriented strand board (OSB), a sturdy plastic, a laminated wood, a workable metal or even a sturdy hard rubber. Depending upon usage, the frame member 2 can be of selected thickness with a border of selected breadth. In the embodiment described above, frame member 2 can be provided with a border 3 of approximately six (6) inches (") to eight (8) inches (") and a thickness of three-eighths (⅜) inches (") and advantageously can be formed from an oriented strand board (OSB) material. An internal perimeter 4 of border 3 of frame member 2 has spaced opposed side portions defining a through-passage 6 therein. As shown in FIGS. 1 and 4, border 3 is provided with opposed pairs of spaced support member aids 7 on opposite spaced sides of the border 3 of frame 2. Here, aids 7 are shown as apertures through which suitable ties or tapes can be passed to hold a fixture 8 (FIG. 4) firmly in suspended position in through-passage 6.

Figure 2:
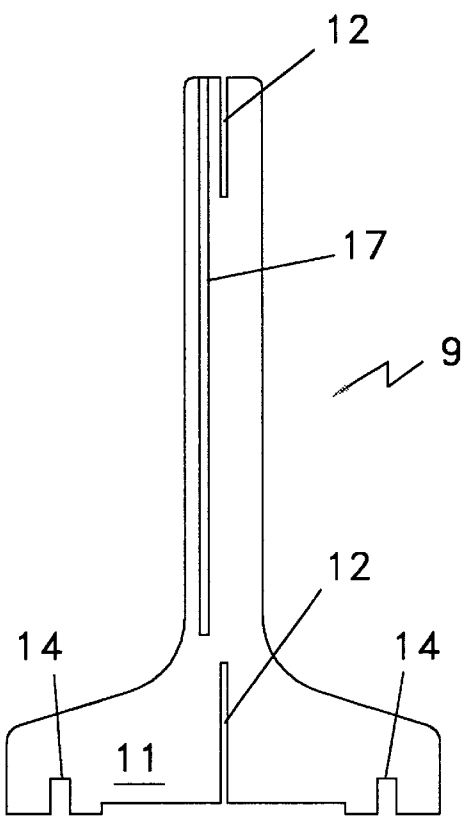
FIG. 2 is a plan view of an inventive body member unit having an integral foot member, the unit being sized and appropriately slotted to be inserted in the through-passage of the frame member when oriented normal to the frame plane with a slotted foot member rest capable of receiving a cross-member support aid.
Figure 2B:
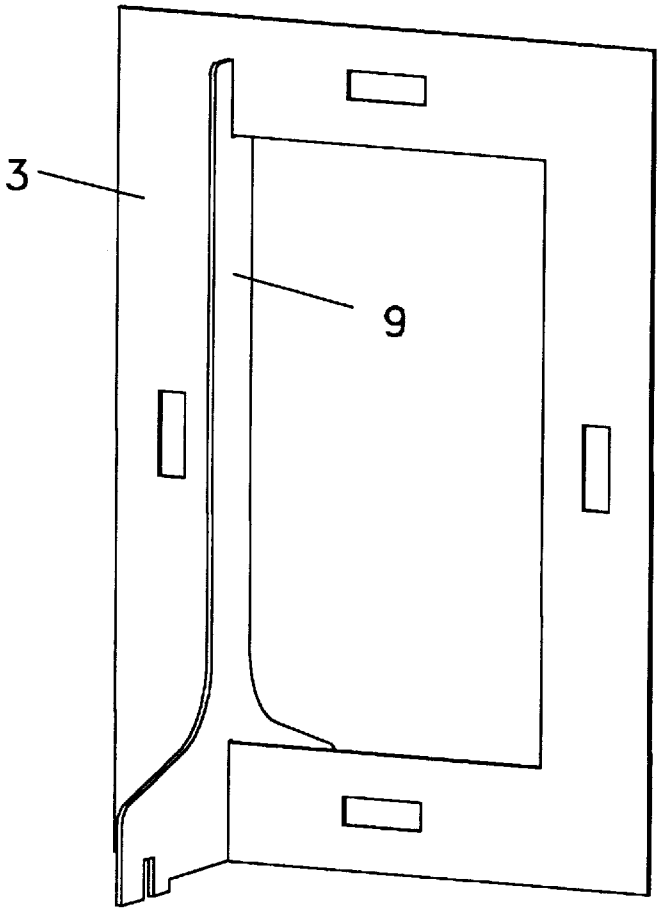
FIG. 2B is a view similar to FIG. 2A, disclosing the longitudinally extending body member of FIG. 2A in vertically erected, slot engaging position.
Figure 2A:
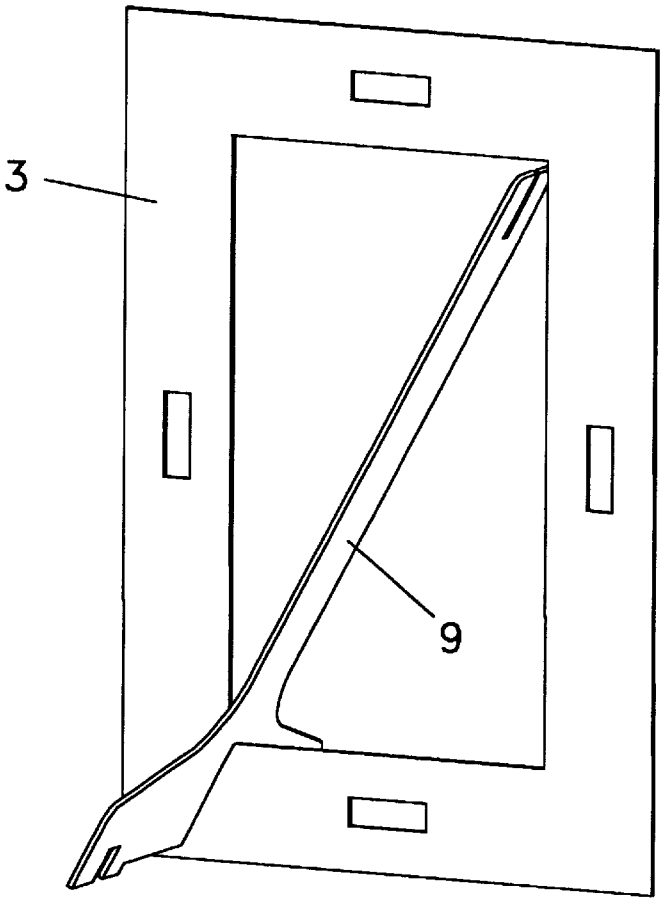
FIG. 2A is a view similar to FIG. 1, disclosing the longitudinally extending body member of FIG. 2 diagonally engaged in the through-passage of the frame member of FIG. 1.

Referring to FIGS. 2 and 4 of the drawings, elongated body members 9 can be seen to be assembled with frame member 2 of FIG. 1 for vertical support of frame member 2. Each body member 9 can be formed from the same material and of the same thickness as frame member 2 or a different material—such as above discussed—with a different thickness can be utilized, if so elected. In the embodiment disclosed, each body member 9 can be seventy-one (71) inches long and the resting foot 11, which is integrally a part thereof, can be thirty point five (30.5) inches (") across. Advantageously, each body member 9 can be sized to extend into through-passage 6 defined by border 3 of frame member 2 along diametrically opposed hypotenuse forming corners thereof (FIG. 2A) and then erected vertically into full slot-engaging position (FIG. 2B)—it being noted that body member 9 is provided with slots 12 at opposite extremities thereof.

Slots 12 are of sufficient depth and breadth to allow engagement with one pair of spaced opposed sides of frame member 2 when finally oriented in a normal position to the plane of through-passage 6 of frame member 2 with resting foot members 11 extending normal to such through-passage plane (FIG. 4). Although it would be possible to provide only one body member 9 to extend centrally and longitudinally in through-passage 6 between a pair of spaced opposed sides of frame member 2 with resting foot member 11 augmented by one or more cross-member aids 13 (FIG. 3)—as described hereinafter (FIG. 5)—in the advantageous embodiment of FIG. 4, a pair of mirror image slotted body members 9 can be seen in such FIG. 4.

These mirror image body members 9 can be arranged to extend in spaced mirror-image fashion adjacent to and along one pair of opposed sides of frame member 2 with spaced opposed slots 12 of each body member 9 engaging with the other pair of opposed sides of frame member 2 and with spaced resting foot members 11 of each body member extending normally from the plane of frame member 2 in supportive position for such frame member when erected.

As can be seen in FIG. 4 of the drawings, moveable caster wheels 10 can be provided to allow for ready movement of the assembled structure.

As can be seen in FIG. 2, the opposed distal extremities of each resting foot member 11 of body member 9 can be provided with slots 14 to receive slots 16 of cross-member 13 with engaging slots 14 and 16 being of sufficient depth and breadth to permit such engagement and thus, augmentation of support aid for an assembled fixture structure.

In this regard, it is to be noted that each cross-member 13 can be so sized in length that each distal end of a resting foot 11 can be engaged by an augmenting supportive cross-member 13 so that a pair of spaced mirror-image body members 9 are provided with a total of four cross members.

Further, it is to be understood that each cross-member 13 can be so sized in length that only one pair of augmenting supportive slotted cross-members 13 can be required with each cross-member engaging both corresponding distal portions of resting feet 11 extending normal from either side of the plane determining a frame member.

Figure 5:
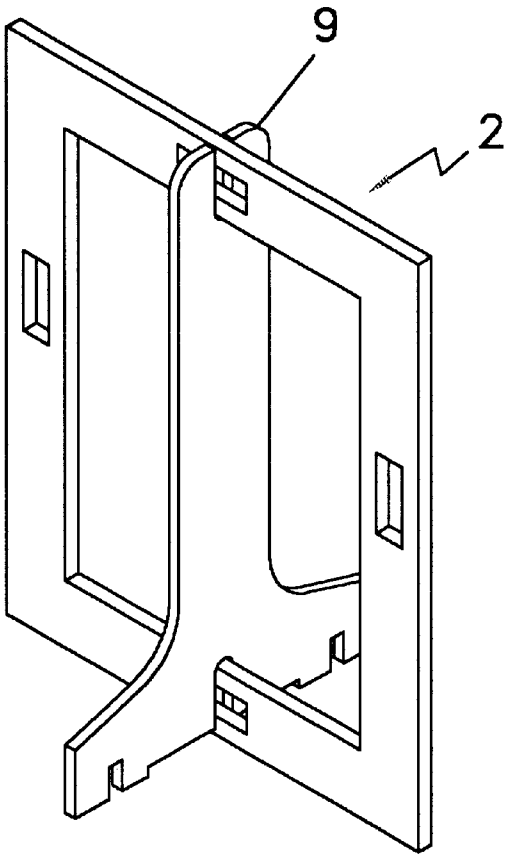
FIG. 5 is an isometric view of another embodiment of the present invention similar to that of FIG. 4 including a frame member and a single centrally disposed body member with the slotted footrest assembled to receive cross-member slotted footrest support aids.

It further is to be understood, and as shown in FIG. 5, an appropriate, slotted spaced cross-member pair 13 (not shown) can be provided with a centrally disposed body member 9 to augment support for such an assembled fixture. And, in fact, the slots as above discussed for the distal ends of foot rests 11 and cross-members can be appropriately cut at a selected angle to allow the plane of frame member 2 to be positioned in a leaning posture when the inventive assembly structure is used for visual aid purposes.

Figure 6:
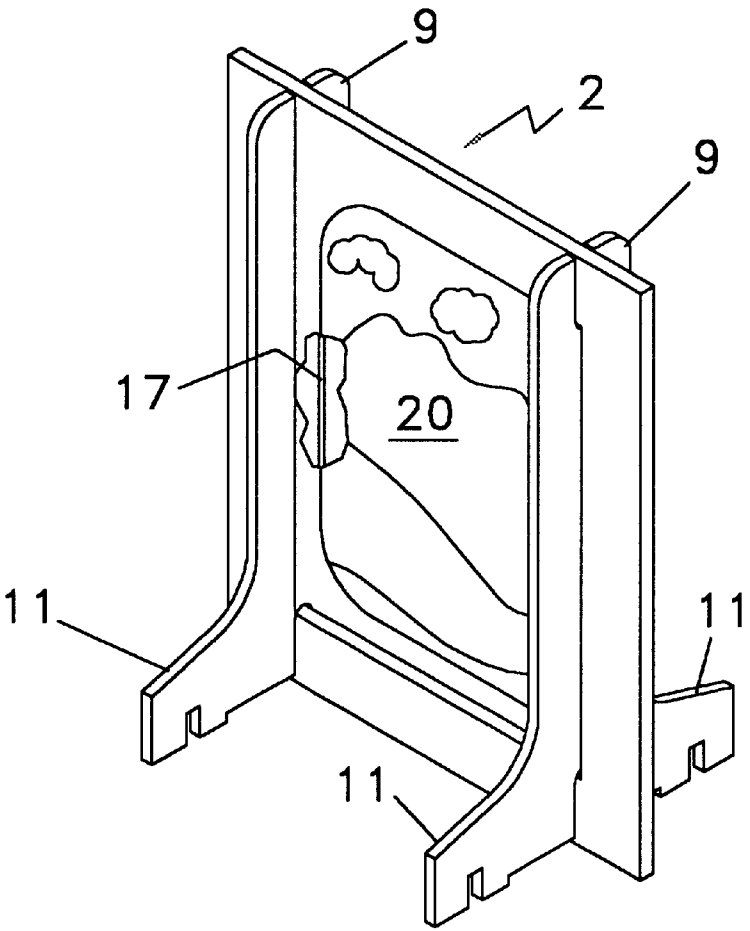
FIG. 6 is an isometric view similar to the view of FIG. 1 of a smaller assembly of a frame member with elliptical-like through-passage and without tie passage apertures but with spaced mirror image body members having spaced opposed longitudinally extending recesses (broken away) which serve to retain opposed side edges of a picture or advertising display mounted in the elliptical-like through-passage; and, FIG. 7 is a schematic flow plan arrangement for forming and assembling the several units of the novel invention.

Referring to FIG. 6, such visual aid embodiment of the present invention with an elliptical-like through-passage is disclosed wherein the longitudinally extending portion of body member 9 positioned above resting foot 11 is shown in the broken away portion of FIG. 6 as provided with a longitudinally extending recess 17. Such a recess 17, as seen in FIG. 2, can extend completely through the thickness of body member 9 when only one centrally positioned body member 9 is employed—as above described in FIG. 5. Advantageously, when a pair of spaced mirror-image body members 9 are employed (FIG. 4), spaced mirror image longitudinally extending recesses 17 can be employed and, if elected, need be formed in only a portion of the depth or thickness of each body member 9, the depth being only sufficient to receive opposed edges of a pictorial display 20 to be accommodated by a structurally assembled support fixture. Such a support fixture can be of an elected large size to accommodate advertising billboards or of a comparatively smaller size to serve as a personal picture frame assembly with slots appropriately slanted to allow the plane of frame member 3 to rest at selected angle position.

Figure 7:
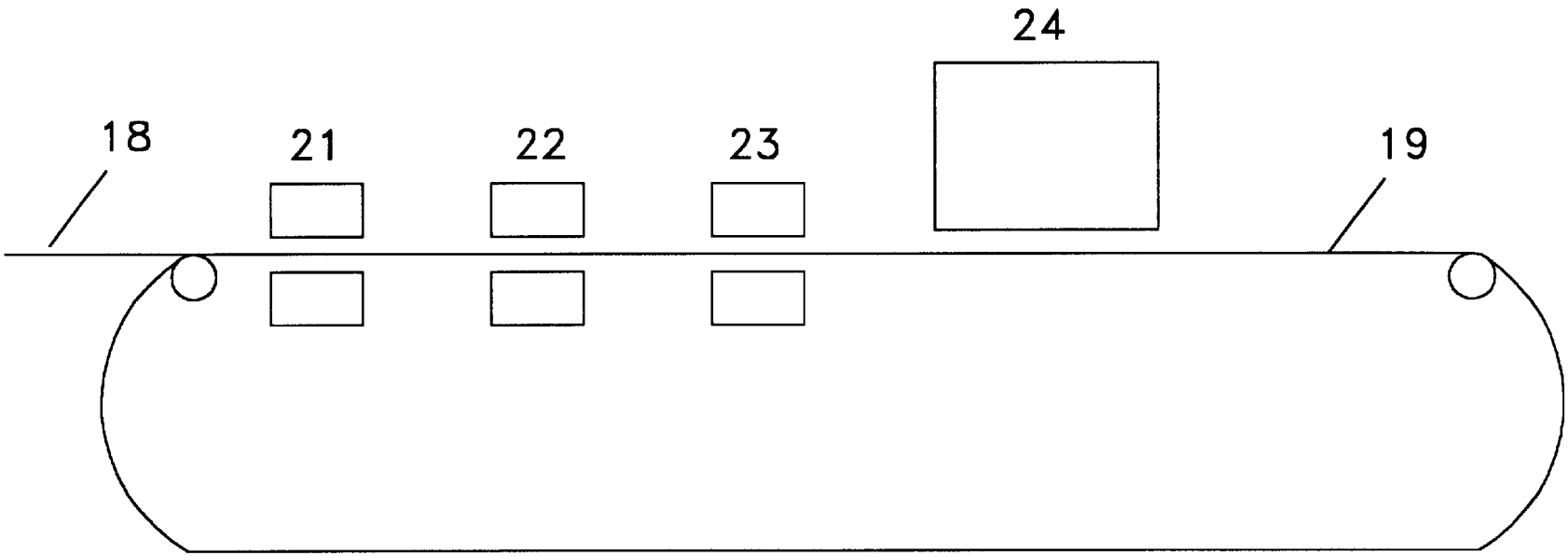

Referring to FIG. 7 of the drawings which discloses a novel schematic flow plan arrangement for forming and assembling the novel structural fixture herein-before described, blank sheets of selected material 18, such as oriented strand board (OSB), are fed by a suitably driven endless conveyor 19 (drive not shown) into a first forming zone 21 to form frame members 2 by one of several forming tools, such as by stamping, punching or laser. As above described, the formed frame member 2 includes a border 3 with surrounding inner perimeter 4 defining through-passage 6 and including support apertures 7.

In the flow plan embodiment schematically disclosed, the frame member 2 can be of rectangular shape but it is to be understood that other shapes can be used such as oval, elliptical-like or circular—depending on market place requirements.

In similar fashion, further sheets 18 or a continuous same sheet from which the frame member 2 has been formed is then fed into a second forming station or zone 22 to sever standard body members 9 such as described above which can include opposed extremity slots 12, bottom foot rests 11 with spaced distal slots 14 and longitudinally extending recess 17 in the main upright portions of body members 9.

Figure 3:
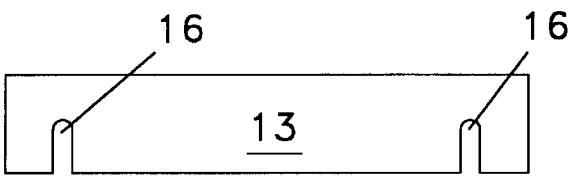
FIG. 3 is a plan view of a slotted cross-member support aid cooperative with a slotted foot member.

In like fashion, further sheets 18 or a continuous same sheets from which the frame member 2 and body member 9 has been formed are fed into a third forming station or zone 23 to sever or stamp cross-members support aids 13 with slots 16 (FIG. 3). It is to be understood that all slots formed in the various stations or zones 21, 22 and 23 are of sufficient depth and breadth to be capable of snuggly engaging opposed faces of the parts to which they are assembled.

Once each frame 2, standard body member 9 and cross-members 13 have been respectively formed in stations or zones 21, 22, and 23 respectively, the several parts are moved to an assembly zone 24, where the body members 9 are slot assembled with the frame members 2 in a manner normal to the plane of the frame members and the cross-members are slot assembled to the distal ends of the body member foot rests—all in a manner as above discussed and, in various selected sizes to provide one or more assembled structural fixture assemblies in one or more of the inventive embodiments as aforedescribed and as set forth in the drawings.

The invention claimed is:

1. A structural fixture assembly comprising: a frame member having an internal perimeter defining an uninterrupted through-passage therein surrounded by selectively spaced opposed side portions which define an uninterrupted area for surroundingly supporting a foreign article to be disposed in a selected position therewithin; and, including at least one standard body member sized to extend into said defined passage, said standard body member being selectively capable to have a longitudinally extending support recess and having slots at opposite extremities thereof capable of engaging in fast interlocked relation with said spaced side opposed portions of said frame member and including at least one assembly resting foot member extendable at a selected angle from said standard body member to provide an erected rest position for said structural assembly.

2. The structural fixture assembly of claim 1, wherein said standard body member when with a selectively capable longitudinally extending recess may serve to retain a display illustration therein when in erected position.

3. The structural fixture assembly of claim 1, wherein a pair of two mating body members are sized to extend into said frame member passage in spaced opposed relation, each body member having slots at opposite extremities thereof capable of engaging in fast relation with said spaced side opposed portions of said frame member with each body member extending adjacent one of said spaced side portions of said frame member in spaced mirror image fashion and with each body member including one of a pair of spaced resting foot members extending at spaced selected angles from said body member to provide an erected position for said structural assembly.

4. The structural fixture assembly of claim 1, said at least one resting foot member having a slot selectively positioned in distal relation therein and a slotted cross-member engaging with said foot member along said slot thereof to augment said resting foot member support.

5. The structural fixture assembly of claim 3, each of said pair of mirror image spaced opposed body members being provided with one of a pair of longitudinally extending mirror image recesses, each recess being in opposed spaced relation to the recess of the other so as to fastenly receive in nesting relation the opposed edges of a display sheet for visual viewing in said through-passage.

6. The structural fixture assembly of claim 5, said opposed recesses being selectively shaped to enhance display sheet edge engagement with said frame member and visual viewing in said through-passage.

7. The structural fixture assembly of claim 3, each of said resting foot members having at least one of a pair of mirror image slots selectively disposed therein and each having a slotted cross member extending substantially normal thereto to engage with said respective foot member to augment said resting foot member support.

8. The structural fixture assembly of claim 5, wherein said assembly is sized to provide a personal picture frame.

9. The structural fixture assembly of claim 5, wherein said assembly is sized to provide advertising billboard.

10. The structural fixture assembly of claim 1, wherein said frame member is of rectangular shape.

11. The structural fixture assembly of claim 1, wherein said frame member is of elliptical-like shape.

12. The structural fixture assembly of claim 1, said frame member including at least one support member to provide for suspension of an article in said through-passage.

13. The structural fixture assembly of claim 1, said frame member including a plurality of spaced support member aids in the form of openings extending adjacent the through-passage defining perimeter thereof to accommodate ties for the suspension of an article in said through-passage in more than one position.

14. The structural fixture assembly of claim 1, said body member being longitudinally sized to diagonally engage for erection in the through-passage of said frame member.

15. The structural fixture assembly of claim 1, and caster wheel assemblies mounted at the bottom of said fixture assembly to allow ready movement thereof.

16. A structural fixture assembly comprising: a rectangular fiber board frame member providing a perimeter defining rectangular through-passage therein surrounded by pairs of spaced opposed side portions, said frame member having opposed pairs of spaced support member aids in the form of spaced apertures disposed on opposite sides of said rectangular frame member to accommodate ties for the suspension of an article in said through-passage in more than one position; a pair of two mating fiberboard body members sized to extend for erection into said rectangular through-passage of said frame member along diametrically opposed hypotenuse forming corners thereto, each body member having slots of opposite extremities thereof of sufficient depth and breadth to allow engagement with one pair of said spaced opposed side portions of said rectangular frame member to extend vertically in spaced mirror image fashion along and adjacent said other pair of sides of said rectangular frame; each body member including one resting foot member extending substantially normally from said body member to provide an erected position for said structural assembly.

17. A method of forming and assembling a structural fixture comprising: feeding a blank sheet of selected material into a first forming zone to sever a frame member from a portion thereof, said frame member being severed to have a perimeter with spaced side portions defining a through-passage therein; feeding a blank sheet of selected material into a second forming zone to sever at least one standard body member having a foot member extendable from said body member to provide a resting foot, said body member including slots at opposite ends thereof, said slots being of sufficient depth and breadth to be capable of snuggly engaging spaced side portions along opposite faces of said spaced opposed side portions of said frame member, and, assembling said body member to said frame member in an additional assembly zone by positioning said body member in said through-passage of said frame member normal to the determining plane of said frame member with the slots of said body member snuggly engaging along opposite faces of spaced opposed portions of said frame member sides.

18. The method of forming and assembling a structural fixture of claim 17, wherein spaced opposed recesses are severed through said spaced opposed portions of said perimeter defining flame member to provide for the passage of holding ties for an article to be suspended in said through-passage.

19. The method of forming and assembling a structural fixture of claim 17, wherein spaced opposed recesses are severed in longitudinally extending fashion at least partially through spaced opposed portions of said perimeter frame member to receive and retain opposed edges of a display sheet.

20. The method of forming and assembling a structural fixture of claim 17, wherein a blank sheet of selected material is fed into a third zone to sever at least one slotted cross-member with a slot of sufficient depth and breadth to cooperate with a similar slot in said resting foot member of said body member in said assembly zone to enhance erection stability of said assembled fixture.

21. The method of forming and assembling a structural fixture of claim 17, wherein a pair of slotted mating standard body members are severed in said second forming zone to be assembled to said frame member in said assembly zone to extend in opposed spaced mirror-image relation adjacent opposed side portions of said frame member.

22. The method of forming and assembling a structural fixture of claim 17, wherein said blank sheet of selected material is a sturdy fiber board material.

* * * * *